US005125340A

United States Patent [19]

Moore

[11] Patent Number: 5,125,340

[45] Date of Patent: Jun. 30, 1992

[54] OSCILLATOR APPARATUS FOR IMPARTING AXIAL OSCILLATIONS TO A ROLLER

[75] Inventor: Andrew L. Moore, Chicago, Ill.

[73] Assignee: Rockwell International Corporation, El Segundo, Calif.

[21] Appl. No.: 586,355

[22] Filed: Sep. 21, 1990

[51] Int. Cl.[5] ..... B41F 31/14; B41G 27/28; B41G 27/16

[52] U.S. Cl. ..... 101/348; 101/DIG. 38

[58] Field of Search ..... 101/348, 349, 350, 148, 101/DIG. 38, 206, 207; 29/116.1, 110, 115; 91/210, 211, 214, 216 R, 216 A, 228

[56] References Cited

FOREIGN PATENT DOCUMENTS 0093150 6/1982 Japan ..... 101/348

*Primary Examiner*—J. Reed Fisher

*Attorney, Agent, or Firm*—C. B. Patti; V. L. Sewell; H. F. Hamann

[57] ABSTRACT

An oscillator apparatus for imparting axial oscillations to a roller (10). The roller (10) has at least a cylindrical outer core (12) rotatable about a stationary shaft (14), that is, the shaft (14) is stationary relative to the outer core (12) of the roller (10). The oscillator apparatus is connected to a supply (46) for providing a pressurized medium. The oscillator apparatus has at least one reciprocating assembly (30, 32) having a substantially stationary portion attached to the stationary shaft (14) and a moveable portion attached to the outer core (12), the reciprocating assembly (30, 32) also having at least first and second ports (52, 54) connected to the supply (46). The supply (46) alternately provides the pressurized medium to the first and second ports (52, 54) to activate the reciprocating assembly (30, 32). The reciprocating assembly (30, 32) is a piston assembly having a piston (30) moveable within a housing (32) between a first area (34) connected to the first port (52) and a second area (36) connected to the second port (54). Either, the housing (32) can be the substantially stationary portion and the piston (30) can be the moveable portion, or the housing (32) can be the moveable portion and the piston (30) can be the substantially stationary portion. The oscillator apparatus further has an anti-rotation pin (56) on the stationary shaft (14) for engaging the moveable portion of the reciprocating assembly (30, 32) to prevent the moveable portion of the reciprocating assembly (30, 32) from rotating about the shaft (14). Furthermore, the oscillator apparatus can have at least first and second passages (84, 86) in the stationary shaft (14) extending from substantially an end (18) of the shaft (14) to the location of the reciprocating assembly (70, 72) on the shaft and interfacing with the first and second ports (74, 76), respectively, thereat, the supply (46) being connected to the first and second ports (74, 76) via the first and second passages (84,86), respectively.

4 Claims, 4 Drawing Sheets

OSCILLATOR APPARATUS FOR IMPARTING AXIAL OSCILLATIONS TO A ROLLER

BACKGROUND OF THE INVENTION

The present invention relates in general to machinery, such as printing presses, which utilize one or more rollers, such as form rollers, inking rollers and transfer rollers as known in the art of lithographic printing. More specifically, the present invention relates to an apparatus for imparting axial oscillations to a roller or similar device.

Such rollers as found in the prior art typically have a cylindrical outer core which is rotatable about a stationary shaft. It is to be understood that the shaft is stationary relative to the outer core of the roller. Depending upon the application it can be envisioned that the outer core is actually held stationary in reference to a frame while it is the shaft that rotates, which is equivalent to a rotation of the outer core relative to the shaft. In the art of printing presses different apparatus are known which provide endwise or axial vibration to particular rollers in the press. These prior art devices for imparting axial oscillation are typically complex in construction and therefore are expensive. Also, they cannot easily be incorporated into an existing roller on a printing press which previously had no oscillation characteristics The present invention overcomes these drawbacks of the prior art and provides an improved oscillator apparatus for use in printing presses as well as other types of machinery.

SUMMARY OF THE INVENTION

It is an object of the present invention to provide an improved oscillator apparatus for imparting axial oscillation to a roller.

It is a further object of the present invention to provide an oscillator apparatus which is small in size and which can be easily fitted to existing rollers in presses for a variety of applications.

It is yet another object of the present invention to provide an oscillator apparatus which is inexpensive compared to prior art oscillator devices.

It is yet another object of the present invention to provide an oscillator apparatus which can be operated using various types of pressurized fluids or gasses.

It is a further object of the present invention to provide an oscillator apparatus for use with a roller which allows the roller to be independently adjusted.

These objects are achieved by an improved oscillator apparatus which imparts axial oscillation to a roller, wherein the roller has at least a cylindrical outer core rotatable about a stationary shaft, that is, the shaft is stationary relative to the outer core of the roller. The oscillator apparatus is connected to a pressure means for providing a pressurized medium. At least one means for reciprocating has a substantially stationary portion attached to the stationary shaft and a movable portion attached to the outer core. The means for reciprocating also has at least first and second ports connected to the pressure means. The pressure means alternately provides the pressurized medium to the first and second ports and activates the means for reciprocating.

In a preferred embodiment the means for reciprocating is a piston assembly having a piston movable within a housing between a first area connected to the first port and a second area connected to the second port. In one embodiment the housing of the piston assembly is the substantially stationary portion and the piston of the piston assembly is the movable portion. In another embodiment the housing is the movable portion and the piston is the substantially stationary portion. The oscillator apparatus can further have an anti-rotation means on the stationary shaft for engaging the movable portion of the means for reciprocating to prevent the movable portion of the means for reciprocating from substantially rotating about the shaft. The shaft has a cylindrical configuration for this embodiment with the anti-rotation means. The oscillator apparatus can also have at least first and second passages in the stationary shaft extending substantially from an end of the shaft to the location of the means for reciprocating on the shaft. The first and second passages interface with the first and second ports, respectively. The pressure means is connected to the first and second ports via the first and second passages in this embodiment.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENT

Figure 1:
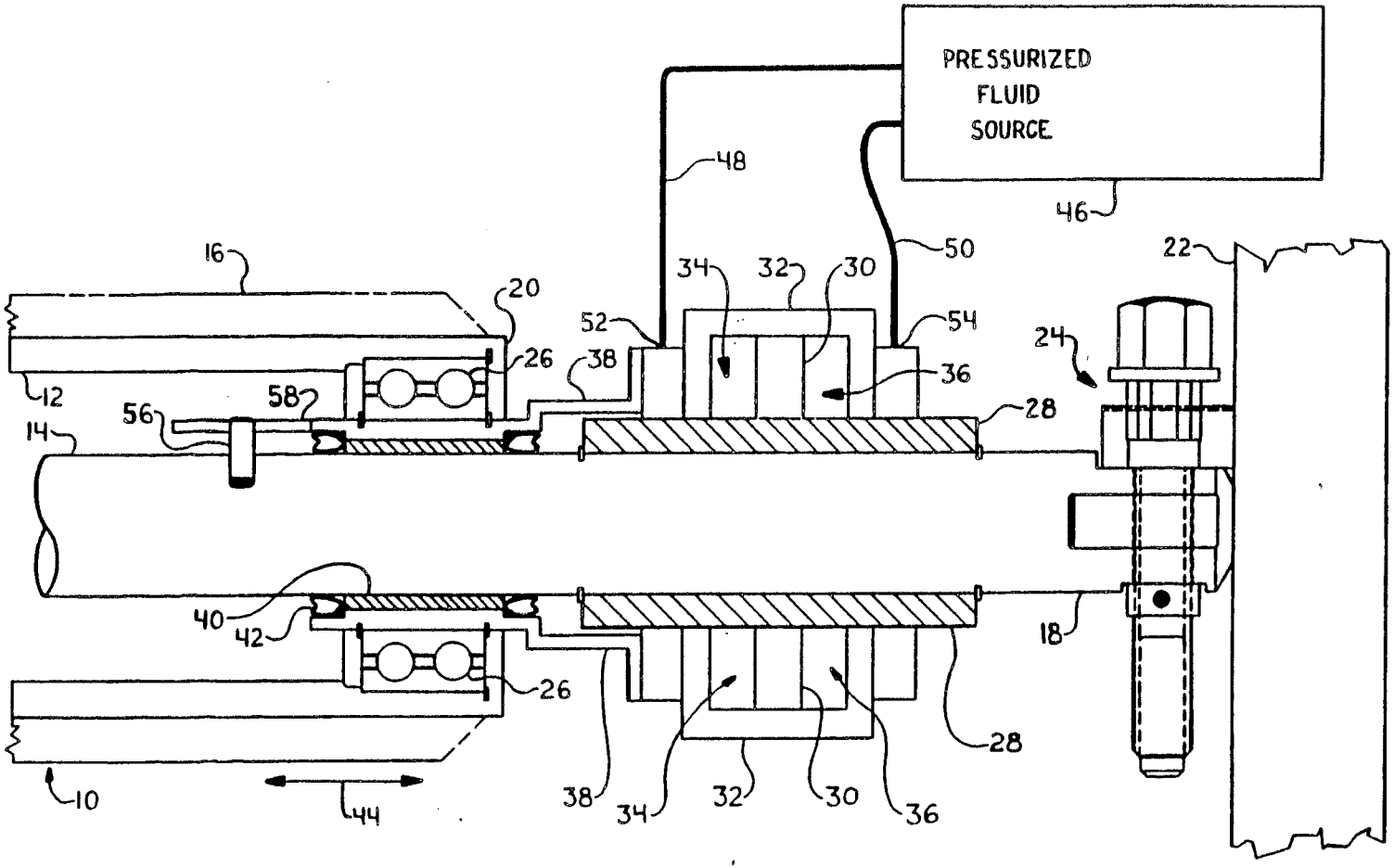
FIG. 1 is a cross-sectional view of the oscillator apparatus of the present invention, wherein a piston of the piston assembly is attached to the stationary shaft of the roller.

The present invention has general applicability but is most advantageously utilized for a roller used in a printing press. As depicted in FIG. 1, a roller 10 has a cylindrical outer core 12 rotatable about a stationary shaft 14. As is known in the art of printing presses the roller core 12 typically has a roller covering 16 on an outer surface thereof. A first end 18 of the shaft 14 extends outward from a first end 20 of the roller core 12 and is attached to a frame 22 by means of an adjustable mechanism 24. Such adjustable mechanisms 24 are also known in the art of printing presses and can have a variety of forms which are familiar to one skilled in the art.

In the embodiment depicted in FIG. 1, the roller core 12 is connected to the shaft 14 via ball bearing assemblies 26. The ball bearing assemblies 26 allow the roller core 12 to rotate about the shaft 14. It is to be understood that a similar configuration is provided for the other end of the roller 10 (not shown).

A cylinder rod 28 and piston 30 are attached to the shaft 14 near the first end 18, as shown in FIG. 1. The piston 30 is movable within a housing 32 between a first area 34 and a second area 36. The housing 32 is attached to a roller slide 38 which is in turn connected to the ball bearing assembly 26. A linear bearing 40 protected by seals 42 is located between the roller slide 38 and the shaft 14. This allows the roller slide 38 to oscillate back and forth in the direction of arrows 44 thereby imparting oscillations or vibrations to the roller core 12 via the ball bearing assemblies 26.

In the embodiment depicted in FIG. 1, a pressurized fluid source 46 is connected by lines 48 and 50 to first and second ports 52 and 54 in the housing 32. The pressurized fluid source 46 alternately supplies the pressurized fluid to the first and second ports 52, 54 which are connected respectively to the first and second areas 34, 36. This causes the housing 32 to oscillate back and forth over the piston 30. Since the housing 32 is connected to the roller slide 38, the oscillations are thus imparted to the roller core 12 as it rotates about the shaft 14 during operation of the printing press. It is to be understood that in this embodiment the cylinder rod 28, the piston 30 and the housing 32 completely surround the shaft 14 in an annular configuration. It can be envisioned that other configurations which do not totally surround the shaft 14 are also possible with the present invention.

In order to prevent the housing 32 from rotating about the piston 30 and cylinder rod 28 as the roller core 12 rotates about the shaft 14, an anti-rotation pin 56 is provided on the shaft 14 which contacts extension 58 of the roller slide 38.

Thus, in general terms the present invention has at least one means for reciprocating, which is a piston assembly consisting of at least the piston 30 in the housing 32, having a substantially stationary portion attached to the stationary shaft 14 and a movable portion attached to the outer core 12. In the embodiment depicted in FIG. 1, the substantially stationary portion is the piston 30 and the immovable portion is the housing 32. It is also to be understood that in the FIG. embodiment the lines 48 and 50 obviously must be sufficiently flexible since the housing 32 oscillates in an axial direction relative to the shaft 14.

Figure 2:
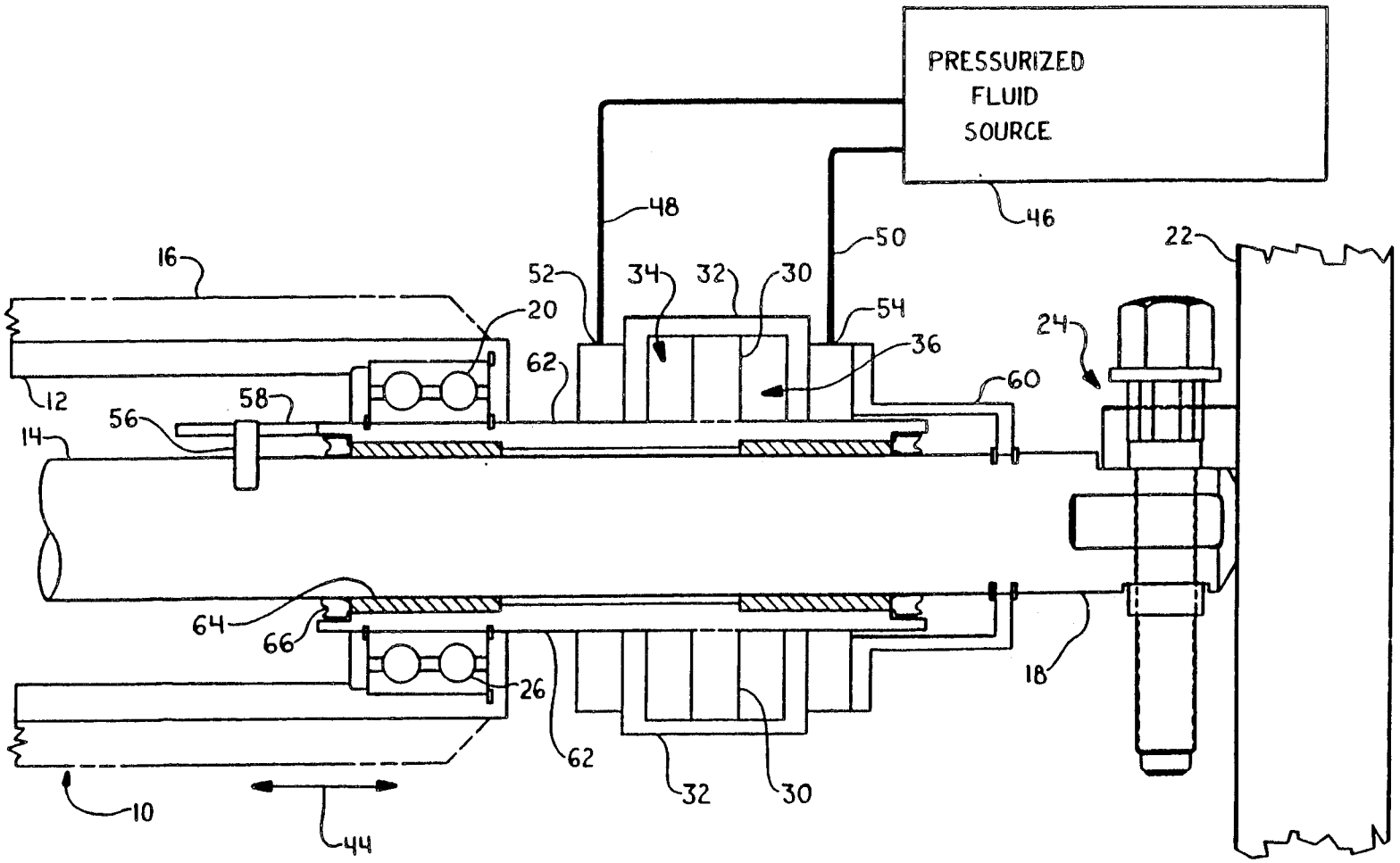
FIG. 2 is a cross-sectional view of another embodiment of the present invention, wherein the housing of the piston assembly is attached to the shaft of the roller.

FIG. 2 depicts an alternative embodiment of the oscillator apparatus of the present invention in which the housing 32 is rigidly connected to the shaft 14 by bracket 60. As the pressurized fluid source 46 provides the alternating pressurized fluid on lines 48 and 50, the piston 30 moves back and forth between the first and second areas 34, 36 in the housing 32. The piston 30 is connected to cylinder rod 62 which in turn is connected to the bal bearing assembly 20. The cylinder rod 62 rides on linear bearings 64 which are protected by seals 66. Other elements of the FIG. 2 embodiment are the same as the elements of the FIG. 1 embodiment. Thus is can been seen that the present invention has the advantage that, depending upon the application or other parameters, either the housing 32 can be the movable portion of the means for reciprocating the roller core 12, (FIG. 1) or the piston 30 can be the movable portion (FIG. 2). The end of the roller 10 opposite the first end 18 can be connected to another frame via a similar adjustment means 24 or rigidly attached depending upon the application. Furthermore, the other end of the roller core 12 can have similar bearing assemblies for connecting the roller core 12 to the shaft 14, allowing rotation about the shaft 14. It can be envisioned that a second means for reciprocating can be located on the opposite end of the roller 10 which, when controlled in a coordinated fashion with the means for reciprocating on the first end of the shaft 14, can jointly impart oscillations to the roller core 12.

Figure 3:
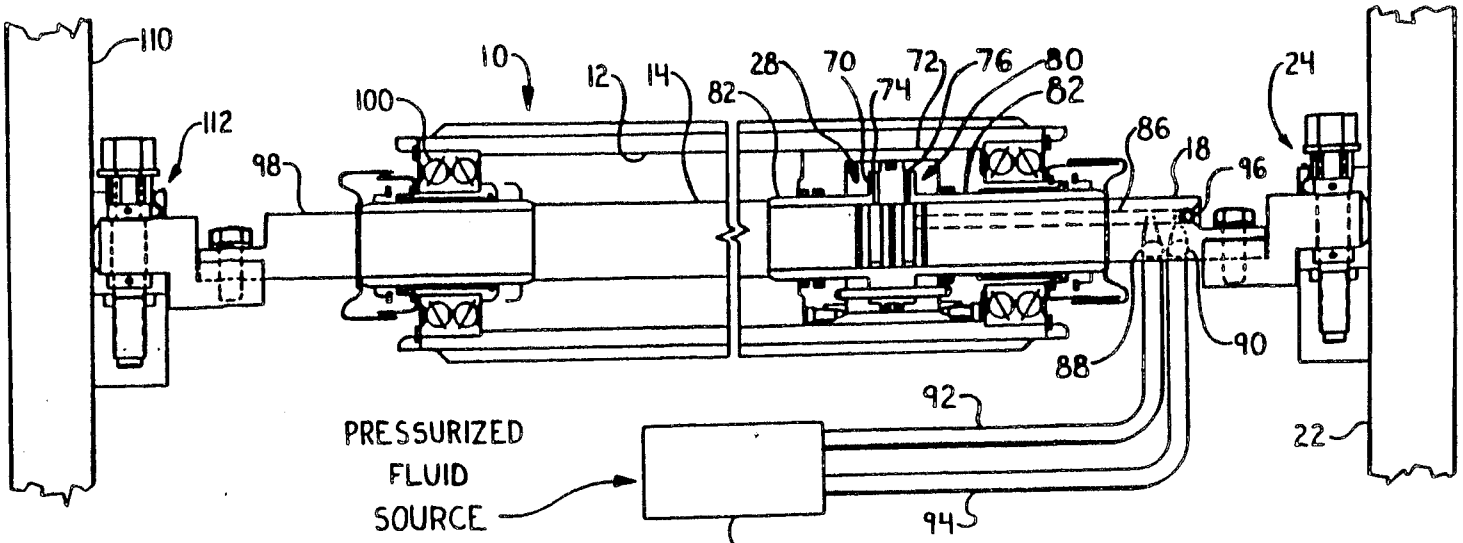
FIG. 3 is a cross-sectional view of yet another embodiment of the present invention, wherein the piston assembly is located between the shaft and the outer core of the roller.
Figure 4:
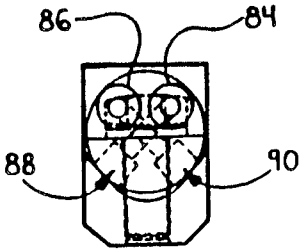
FIG. 4 is a cross-sectional view of the shaft of the roller depicting passages which connect the pressure means to the piston assembly of the FIG. 3 embodiment.

FIG. 3 shows yet another embodiment of the present invention in which the means for reciprocating is located between the shaft 14 and the roller core 12, rather than the locations depicted in FIGS. 1 and 2. In this embodiment a piston 70 is contained within a housing 72. The housing 72 is connected to an inner surface of the roller core 12 and the piston 70 is mounted on the shaft 14. In this embodiment the first and second ports 74, 76, which interface with first and second areas 78, 80, are contained in the piston 70. The piston 70 can be attached to a cylinder rod 82 or can be formed as one piece with the cylinder rod 82. The first and second ports 74, 76 are connected to first and second passages I0 84, 86 which extend in a direction parallel to an axis of the shaft 14 and through the shaft 14. The first and second passages 84 and 86 respectively connect the first and second ports 74 and 76 to a corresponding pair of ports 88, 90 located at the first end 18 of the shaft 14 (also see FIG. 4). The pressurized fluid source 46 is connected to the pair of ports 88, 90 via the lines 92, 94, respectively.

In a preferred embodiment the shafts 84 and 86 are drilled through the shaft 14 from the first end 18, after which ports 88 and 90 are drilled into the first end 18 of the shaft 14 to connect with the passages 84 and 86, respectively. The ends of the shafts 84 and 86 are then plugged by plugs 96. FIG. 3 depicts on a second end 98 of the shaft 14 a second ball bearing assembly 100 which allows the core 12 of the roller 10 to rotate about the shaft 14. The second end 98 can be attached to a corresponding frame 110 via a second adjustable mechanism 112.

In operation the pressurized fluid source 46 provides alternating pressurized fluid in the lines 92 and 94 which is carried to the first and second areas 78, 80 of the piston assembly formed by the piston 70 and housing 72 via shafts 84, 86 and ports 74, 76. The alternating pressurized fluid causes the housing to oscillate back and forth over the piston 70 thereby imparting oscillations to the roller core 12 as it rotates about the shaft 14 of the roller 10. The piston assembly can be located anywhere on the shaft 14 and between the shaft 14 and roller core 12.

Figure 5:
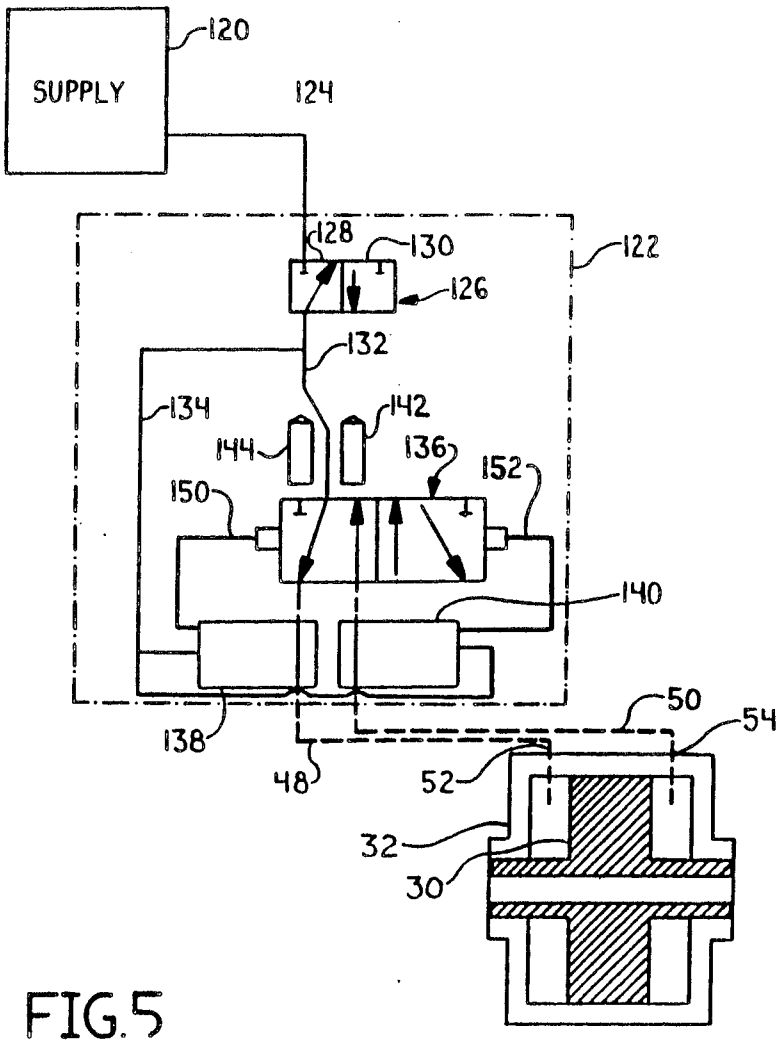
FIG. 5 is schematic representation of a pressure system for providing a pressurized medium to the piston assembly.

FIG. 5 depicts one possible embodiment for the pressurized fluid source 46. Supply 120 provides pressurized fluid, gas or other medium to module 122 on line 124. The line 124 is connected to a solenoid operated spool valve 126 having two positions. The valve 126 is depicted in a closed position 128 and when it is moved to the open position 130, the line 124 is connected to lines 132 and 134 in the module 122. A pilot operated spool valve with two positions 136 is shown in a first position in which line 132 is connected through a sensor 138 to the first port 52 of the housing 32 which contains the piston 30. The second port 54 is connected via a second sensor 140 and valve 136 to a second silencer 142. When the valve 136 is changed to its other position the first port 52 is connected via the sensor 138 and valve 136 to a first silencer 144 and the second port 54 is connected via the sensor 140 and the valve 136 to the line 132. A reference line 134 is connected to each of the sensors 138 and 140. The sensors 138 and 140 are connected by lines 150 and 152, respectively, to the valve 136 for actuating the valve 136.

During operation the sensors 138, 140 sense when the respective pressure levels in the first and second areas 34, 36 attain values relative to the reference pressure on line 134 and cause the valve 136 to change positions. For example, 15 if oil is used as the pressure medium the valve 136 shifts when the pressure becomes high on the inlet port and the sensor on the inlet port effects the switching. When air is used as a medium the valve 136 shifts when the pressure becomes low on the outlet port and the sensor on the outlet port effects the switching. Other configurations and pressurized mediums can be used to provide the alternating pressurized medium on the supply lines 48 and 50.

The invention is not limited to the particular details of the apparatus depicted and other modifications and applications are contemplated Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. Oscillator apparatus for imparting axial oscillations to a roller comprising a roller having at least a cylindrical outer core rotatable about a stationary shaft, that is, the shaft being stationary relative to the outer core of the roller, the oscillator apparatus connected to a pressure means for providing a pressurized medium;

at least one means for reciprocating having a substantially stationary portion attached to said stationary shaft and a movable portion attached to said outer core, said means for reciprocating also having at least first and second ports connected to said pressure means; and said means for reciprocating being a piston assembly having at least a piston movable within a housing between a first area in said piston assembly connected to said first port and a second area in said piston assembly connected to said second port, said housing attached to said core, said first and second ports being located in said piston, the stationary shaft and the outer core forming an elongated hollow chamber and said at least one means for reciprocating being located in said hollow chamber, said housing of said piston assembly being said movable portion and said piston of said piston assembly being said substantially stationary portion;

wherein said pressure means alternately provides said pressurized medium to said first and second ports to activate said means for reciprocating.

2. The oscillator apparatus according to claim 1, wherein said oscillator apparatus further comprises at least first and second passages in said stationary shaft extending from substantially an end of said shaft to the location of said means for reciprocating on said shaft and interfacing with said first and second ports, respectively, thereat, said pressure means being connected to said first and second ports via said first and second passages, respectively;

3. The oscillator apparatus according to claim 1, wherein said means for reciprocating is located adjacent one end of said stationary shaft.

4. Oscillator apparatus for imparting axial oscillations to a roller comprising a roller having at least a cylindrical outer core rotatable about a stationary shaft, that is, the shaft being stationary relative to the outer core of the roller, the oscillator apparatus connected to a pressure means for providing a pressurized medium;

a piston assembly having at least a piston movable within a housing between a first area in said piston assembly connected to a first port and a second area in said piston assembly connected to a second port, said first and second ports being located in said piston, said piston attached to said stationary shaft and said housing attached to said outer core, said stationary shaft and said outer core forming an elongated hollow chamber and said piston assembly located between said stationary shaft and said outer core in said hollow chamber and adjacent one end of said stationary shaft;

at least first and second passages in said stationary shaft extending from substantially said one end of said stationary shaft to the location of said piston assembly on said shaft and interfacing with said first and second ports, respectively, thereat, said pressure means being connected to said first and second ports via said first and second passages, respectively;

wherein said pressure means alternately provides said pressurized medium to said first and second ports via said first and second passages to active said piston assembly.

* * * * *